US005397240A

United States Patent [19]

Herard

[11] Patent Number: 5,397,240

[45] Date of Patent: Mar. 14, 1995

[54] ELECTRICAL CONNECTOR

[75] Inventor: James D. Herard, Vestal, N.Y.

[73] Assignee: International Business Machines Corporation, Armonk, N.Y.

[21] Appl. No.: 143,327

[22] Filed: Oct. 26, 1993

[51] Int. Cl.[6] ..... H01K 23/72

[52] U.S. Cl. ..... 439/66; 439/91; 439/196

[58] Field of Search ..... 439/66, 91, 196, 191, 439/199, 65

[56] References Cited

U.S. PATENT DOCUMENTS

| | | | |
|---|---|---|---|
| 3,638,163 | 1/1972 | Loosme | 439/66 X |
| 3,858,958 | 1/1975 | Davies | 439/66 |
| 4,664,458 | 5/1987 | Worth | 339/17 M |
| 4,863,387 | 9/1989 | Snaper et al. | 439/31 |
| 5,127,838 | 7/1992 | Zaderej et al. | 439/74 |
| 5,137,461 | 8/1992 | Bindra et al. | 439/74 |
| 5,160,268 | 11/1992 | Hakamian | 439/248 |
| 5,174,763 | 12/1992 | Wilson | 439/66 |

FOREIGN PATENT DOCUMENTS

| | | | |
|---|---|---|---|
| 1121011 | 3/1982 | Canada | H01R 9/09 |
| 2914953 | 10/1980 | Germany | 439/66 |

*Primary Examiner*—P. Austin Bradley
*Assistant Examiner*—Jeanne M. Elpel
*Attorney, Agent, or Firm*—Lawrence R. Fraley

[57] ABSTRACT

An electrical connector for interconnecting first and second circuit members wherein the connector includes an insulative, e.g., plastic, housing having a cylindrical metallic conductor rod therein and at least one electrical contact positioned on or within the housing and having opposed conductive end portions. When the connector is in a non-contacting position relative to the circuit members, the contact assumes a first configuration, e.g., oval, and thereafter assumes (moves to) a second configuration, e.g., round, when contact occurs. In this second configuration, the conductive end portions of the contact are equidistant from the conductor rod, thereby assuring a predetermined level of impedance for the connector during operation thereof. An information handling system (computer) which uses such a connector is also disclosed.

17 Claims, 4 Drawing Sheets

ELECTRICAL CONNECTOR

TECHNICAL FIELD

The invention relates to electrical connectors and particularly to such connectors for electrically connecting circuit members, e.g., those typically found in many information handling systems (computers). Examples of such circuit members include printed circuit boards (PCBs), thermal conduction modules (TCMs), and the like.

BACKGROUND OF THE INVENTION

Electrical connectors for interconnecting pluralities of circuit members such as mentioned above in computers and similar equipment are known in the art, with representative examples shown in U.S. Pat. Nos. 4,664,458 (Worth), 4,863,387 (Snaper et al), 5,127,838 (Zaderej), 5,160,268 (Hakamian) and 5,174,763 (Wilson). Typically, such connectors are designed for being positioned between the two circuit members to be coupled with designated contacting elements or the like of the connector projecting or extending from the connector to effect contact with respective conductive members (e.g., flat copper pads) located, usually, on an external surface of the circuit member. Contact is completed in most situations through use of some compression or clamping means that moves one or both of the circuit members toward the other to compress the connector therebetween.

While many such connectors are known to exist, very rarely has consideration been given in the design of such with respect to impedance matching between the connector and one or more of the circuit members. Such is particularly the case with respect to connectors of the high density variety (e.g., those which utilize a plurality of contacts positioned adjacent one another at spacings as close as about 0.050 inch or even less). Impedance matching, as is known, is the process of making equal the impedance when looking both ways from a junction location in two parts of a circuit. In the particular ease of the aforementioned connector structure, this capability serves at least two important functions: (1) it provides a condition of maximum power transfer from one circuit to another for resistive impedances; and (2) it also serves to prevent reflection of voltage and current waves.

In typical computer systems, printed circuit boards and other circuit members are often associated with an established impedance, usually at a level of, say, 50, 70 or 93 ohms. In order to assure the above highly desirable features, therefore, it is important to provide a connector with an associated impedance at a value similar to (matching) these. U.S. Pat. No. 5,174,763 represents one example of a connector which couples two circuit members in a "high density" arrangement with minimum crosstalk (between contacts), selected impedances and minimum inductances. In this patent, a plurality of pairs of projecting probe-type contacts are utilized, each pair associated with some form of spring means which is required to assure external projection. The contacts each include tipped end portions which physically engage the respective conductor pads on the circuit members after passing through provided holes in the outer part of a "frame" designed to accommodate the contacts therein. "Bushing" portions of the frame, located between the contact and an also required ground plating, are apparently intended to provide some form of control of characteristic impedance.

As will be defined hereinbelow, the present invention comprises an electrical connector for interconnecting first and second circuit members wherein a selected level of impedance is substantially assured to thereby match that of one or both of the circuit members and thereby assure the above and other desired features. The invention, while thereby greatly facilitating design of the overall structure using the connector, is uniquely able to provide such a capability with a relatively uncomplicated design, not requiring the several individual elements demanded in U.S. Pat. No. 5,174,763. Significantly, the invention is able to do so and still attain sound, effective coupling at the desired locations. Equally significant, the invention is also able to do so with several contact members closely positioned together in a highly dense arrangement, while also substantially preventing "crosstalk" between adjacent contacts, an undesirable characteristic, particularly in complex electrical structures such as computers.

It is believed that such a connector represents a significant advancement in the art.

DISCLOSURE OF THE INVENTION

It is, therefore, a primary object of the present invention to enhance the art of electrical connectors and particularly those designed for interconnecting circuit members such as PCBs, TCMs, or the like as typically found, e.g., in information handling systems (computers).

It is another object of the invention to provide such a connector which will in turn provide a predetermined level of impedance when actuated (coupled to the circuit members), thereby facilitating design of the ultimate structure using the invention.

It is yet another object of the invention to provide such a connector which is of relatively simple construction, and is relatively inexpensive to produce.

It is a still further object of the invention to provide such a connector which is easy to operate in combination with the various components (circuit members) that it is designed to couple.

In accordance with one embodiment of the invention, there is provided an electrical connector which comprises an electrically insulative housing adapted for being positioned between the first and second circuit members, an electrically conductive member positioned within the housing, and at least one electrical contact positioned within or on the housing and including first and second electrically conductive portions adapted for electrically contacting the first and second circuit members, respectively. The electrical contact is adapted for assuming a first configuration within or on the housing prior to the electrically contacting and thereafter assuming a second configuration different than the first configuration during the electrically contacting. The electrically conductive portions of the electrical contact are substantially equidistant from the electrically conductive member when the electrical contact assumes the second configuration during the electrically contacting with the first and second circuit members.

In accordance with another aspect of the invention, there is provided an information handing system including a first circuit member, a second circuit member, and a connector for electrically interconnecting said first and second circuit members. The connector includes an electrically insulative housing adapted for being positioned between the first and second circuit members, a electrically conductive member positioned within the housing, and at least one electrical contact positioned within or on the housing and including first and second electrically conductive portions adapted for electrically contacting the first and second circuit members, respectively. The electrical contact is adapted for assuming a first configuration within or on the housing prior to the electrically contacting and thereafter assuming a second configuration different than the first configuration during the electrically contacting, the electrically conductive portions of the electrical contact being substantially equidistant from the electrically conductive member when the electrical contact assumes the second configuration during the electrically contacting with the first and second circuit members.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
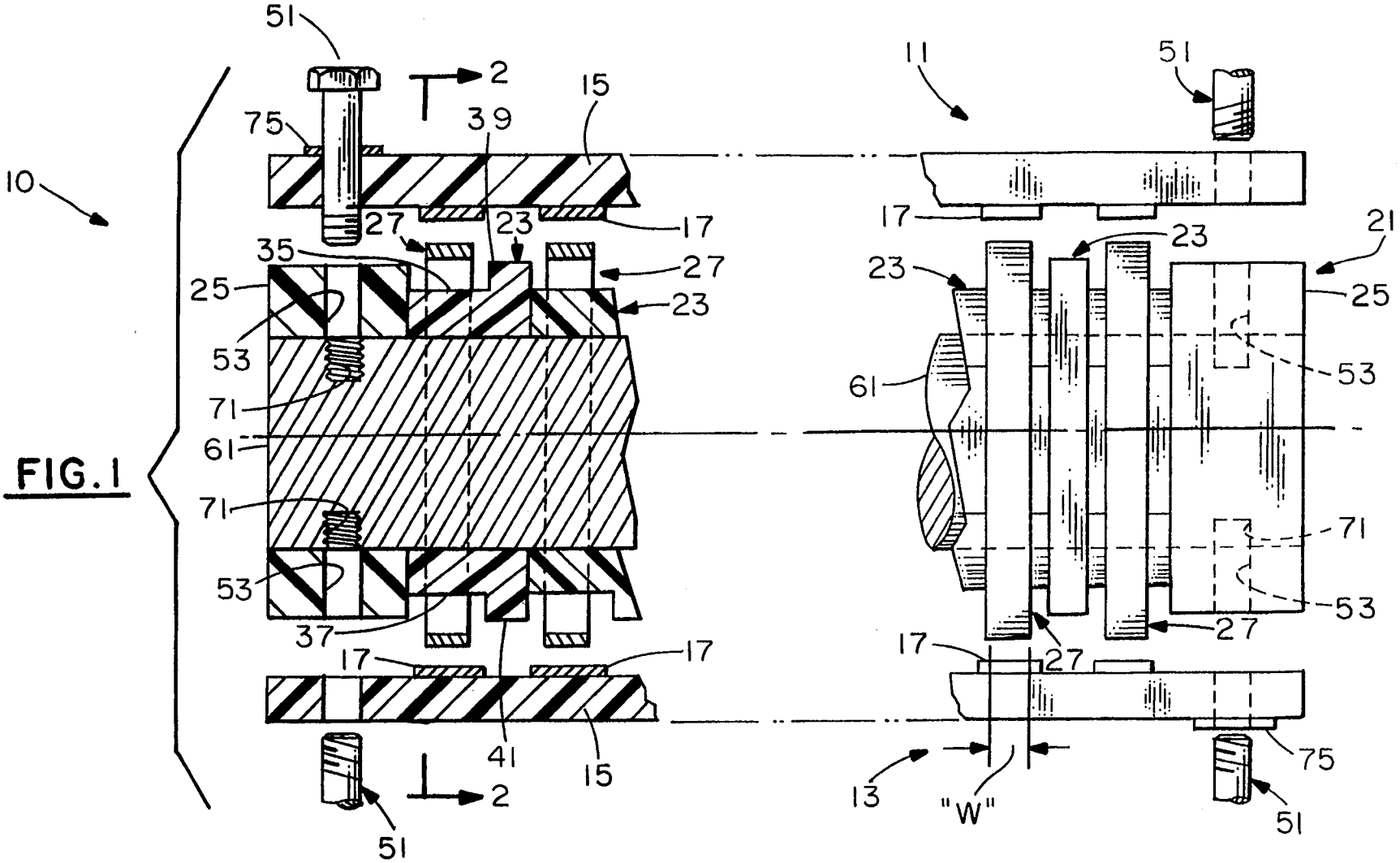
FIG. 1 is a front elevational view, in section, of an electrical connector in accordance with a preferred embodiment of the invention, the connector being shown prior to electrical coupling with first and second circuit members, also shown.

In FIG. 1, there is shown a connector 10 for interconnecting, electrically, first and second circuit members 11 and 13 in accordance with a preferred embodiment of the invention. Examples of suitable circuit members for being interconnected by connector 10 include printed circuit boards (PCB's), circuit modules, etc. The term printed circuit board as used herein is meant to define a multilayered circuit structure including one or more conductive (e.g., signal, power and/or ground) layers located within and/or upon a suitable dielectric substrate material. Such printed circuit boards, also known as printed wiring boards, are well known in the art and further description is not believed necessary. By the term circuit module is meant to include a substrate or the like member having various electrical components (e.g., semiconductor chips, conductive circuitry, conductive pins, etc.) which may form part thereof. Such modules are mentioned in U.S. Pat. Nos. 4,688,151 and 4,912,772 and further description is thus not believed necessary. The disclosures of these patents are thus incorporated herein by reference. In FIG. 1, two PCBs are shown for being connected by the invention. As such, each PCB 11 and 13 includes a dielectric substrate 15 having a plurality of electrical conductors 17 on an external surface thereof. Such conductors, as shown, are preferably substantially flat and located adjacent one another in a close, high-density arrangement. By the term high density is meant to define center-to-center spacings within the range of from only about 0.025 inch to about 0.050 inch between adjacent such conductors. A preferred example of each such conductor 17 is a metallic (e.g., copper) pad having a thickness of only about 0.0002 inch with side dimensions of about 0.020 inch by 0.040 inch. Such pads may also be round or of other than rectangular configurations.

It is noted that the embodiment depicted in FIG. 1 shows the invention and the circuit members for being coupled thereby in cross-sectional configuration (to the left in FIG. 1) and also in non-sectional orientation (to the right in FIG. 1), for illustration purposes.

As stated above, each of the circuit members 11 and 13 is identified with an associated electrical impedance value. Examples of such impedances for many known circuit boards may typically fall within the range of about 50, 70 or 93 ohms. Such impedances are typically associated with the cabling (e.g., coaxial) which provides current to the respective circuit members. As also stated above, it is a primary objective of the present invention to provide an electrical connector with an impedance rating (or value) which substantially matches that of one or both of the circuit members 11 and 13. In a preferred embodiment, each circuit member possesses a substantially similar impedance value (e.g., 93 ohms) and the electrical connector 10 of the invention will in turn provide a similar impedance value. Thus, the various advantages cited above are provided by the instant invention.

As shown in FIG. 1, connector 10 includes an elongated, electrically-insulative housing 21, preferably comprised of plastic material, e.g., polyphenylene sulfide, polyester, nylon, etc. (It is noted that different plastics may possess different dielectric constants, thereby resulting in different impedance values for the invention.) Housing 21 may also be ceramic. As further seen in FIG. 1, housing 21 is preferably comprised of several parts 23 and 25, parts 25 representing end parts (of substantially box-like rectangular configuration) while parts 23 represent interior, individual parts each associated with a respective one of the electrical contacts 27 which also form part of connector 10. Although several contacts and housing parts 23 are shown in FIG. 1, it is understood that the invention is not limited to such numbers in that suitable connection can be provided between paired circuit members using but a singular contact. Thus, in the broader aspects of the invention, it is possible to achieve interconnection between circuit members 11 and 13 using a singular contact 27 for the invention. In a preferred embodiment, however, several contacts are so utilized, and in one example, a total number of fifty will preferably be utilized to interconnect a respective, similar number of pairs of such conductors 17 on members 11 and 13.

Figure 2:
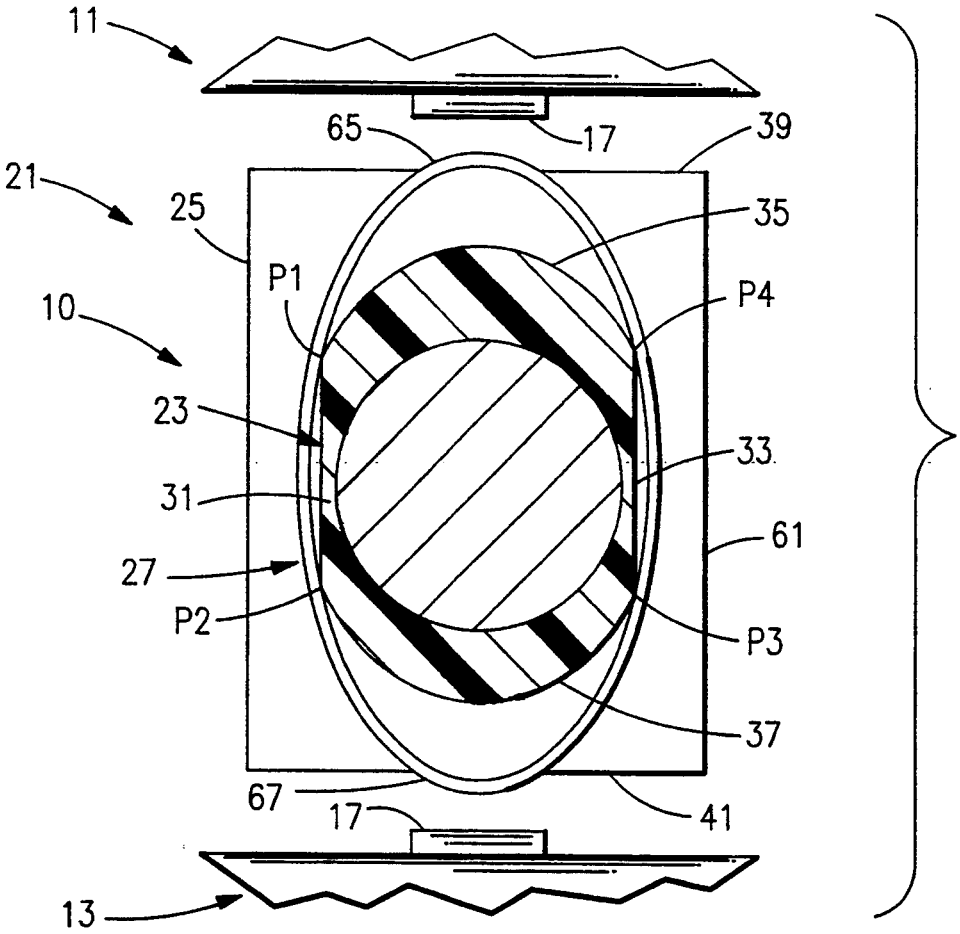
FIG. 2 represents a side elevational view, in section, of the connector in FIG. 1, taken along the line 2—2 in FIG. 1, and on a slightly enlarged scale, the connector shown prior to coupling with associated circuit members.
Figure 3:
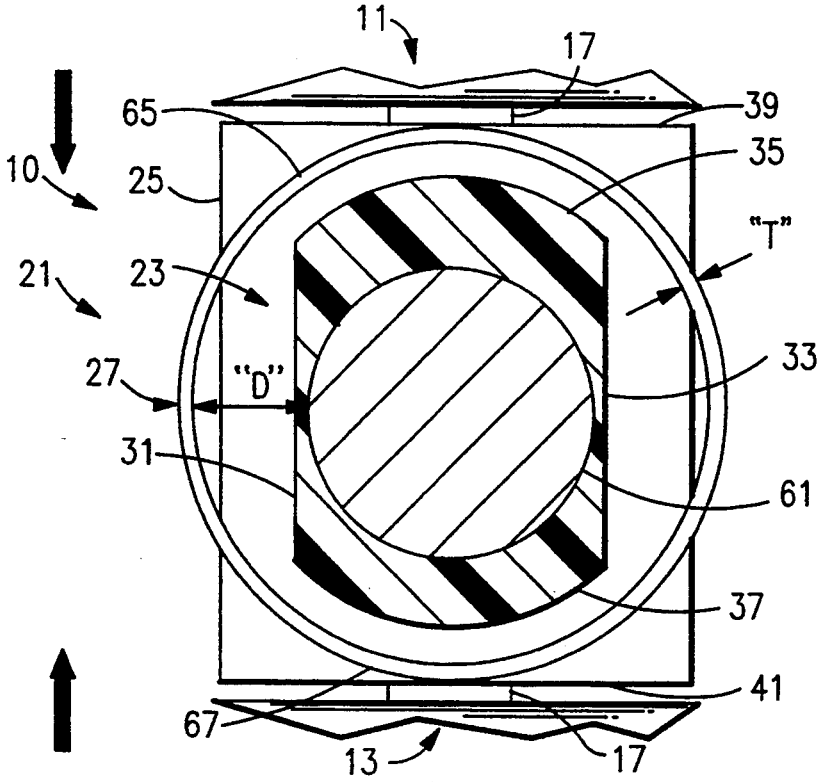
FIG. 3 is a side view of the connector of FIG. 2 (and 1), shown in the actuated position and thus interconnecting the two shown circuit members.

The configuration for end parts 25 can be seen in the sectional view (FIG. 2) taken along the lines 2—2 in FIG. 1. Similarly, the external configuration for one of the housing parts 23 can also be seen in FIG. 2. Part 23, as shown therein, preferably includes opposing vertical, planar face surfaces 31 and 33, with curvilinear upper and lower surfaces 35 and 37 respectively. Such an external configuration is preferred for associated electrical contacts of substantially initial oval configuration as depicted in FIG. 2. Significantly, each part 23 further includes a second pair of opposed upper and lower surfaces 39 and 41 adjacent respective curved surfaces 35 and 37 respectively, to thus define an upwardly projecting rib or the like. It is seen in FIGS. 1–3 that this upstanding rib, in combination with an adjacent upstanding portion (e.g., a similar height part on end part 25 or an adjacent similar rib on an adjacent such part 23) will serve to retain the respective contact associated with this particular part of housing 21 in position. Contact 27 also frictionally engages the opposing sides 31 and 33, e.g., a four locations (P1, P2, P3 and P4) as shown in FIG. 2.

In FIG. 2, contact 27 is shown as of substantially oval configuration, a preferred shape for the contact of the invention prior to engagement with the respective conductor pads 17 during connector actuation. The invention is not to be limited to this configuration, however, in that other configurations (e.g., that shown in FIG. 4) may be successfully utilized. In the embodiment of FIG. 2, contact 27 projects outwardly slightly beyond the housing's upper and lower surfaces, respectively, prior to connector actuation. Such actuation occurs when the respective circuit members 11 and 13 are brought together through use of suitable clamping or compression means. Such means may comprise a clamp or the like element (not shown) which engages the respective circuit members (e.g., along outer surfaces thereof) and brings them together with connector 10 therebetween. In the embodiment of FIG. 1, the use of coupling screws 51 is shown, at least two such screws preferably used for each circuit member. Screws 51 pass through the dielectric substrate 15 of each circuit member and into a respective opening 53 in one of the opposed end parts 25. Thus, each end part 25 includes two opposed such openings 53 therein to accommodate a respective pair of such screws. An optional stiffener member (not shown) located between the screw(s) and substrate 15 may be used.

Connector 10 further includes an electrically-conductive member 61 positioned substantially centrally within housing 21 and thus passing through parts 23 and 25. Conductive member 61 is preferably a substantially cylindrically-shaped metallic (e.g., copper ) rod. This rod, which may be solid or hollow (tubular), is strategically positioned in a substantially central position within the housing of connector 10 such that when contacts 27 are compressed (connector 10 being actuated), the conductive portions of the contact are substantially equidistant (dimension "D" in FIG. 3) from the outer surfaces of member 61. In FIG. 2, it is understood that the contact's opposed conductive portions are represented by the numerals 65 and 67, which, as understood from the drawing, combine to form a closed loop structure for contact 27. Thus, current passing from the upper conductive pad 17 in FIG. 2 will pass through the entirety of contact 27 (both right and left sides as shown in FIG. 2) to the lower conductive pad 17 on circuit member 13. The conductive portions of contact 27 are thereby equidistant from the central conductive member 61.

In a preferred embodiment of the invention, central conductive member 61 possesses a diameter of about 0.090 inch with the respective outer surfaces 35 and 37 possessing an overall height (distance from housing center) for this part (23) of about 0.100 inch. Additionally, the respective ribs for this part 23 extend to a total height of 0.120 inch. Still further, the oval contact shown in FIG. 2 may possess an overall length (from uppermost outer surface to lower most) of about 0.130 inch in its unactuated state. When compressed (FIG. 3), the contact will preferably have a diameter of about 0.120 inch.

As shown in FIG. 1, each screw 51 further extends within a threaded aperture 71 within member 61. Openings 53 are not threaded but merely provide passage for screws 51. Alternatively, these may be threaded.

In FIG. 1, two opposed screws are shown as passing through conductors 75 on circuit members 11 and 13. Two such conductors 75 are utilized, one for each such circuit member. Positioning of the respective screw 51 therethrough and into securement within the conductive member 61 thus provides electrical coupling between the respective pad and member, and the respective current path through the assembled structure shown in FIG. 1. Rod member 61 is thus adapted for being electrically conductive during connector actuation (current passage through contacts 27). When contact 27 is so compressed to the circular configuration depicted in FIG. 3 and possesses the aforementioned dimensions, distance "D" is preferably only about 0.010 inch. Such a distance, using a contact of the dimensions cited above, including having a thickness (dimension "T" in FIG. 3) of 0.005 inch and a width (dimension "W" in FIG. 1) of 0.020 inch, assures an electrical connector with an impedance value of about forty-eight ohms. Additional impedance values can be provided using the connector shown herein through use of different diameter conductive members 61 and/or contacts which provide a different, final compressed outer configuration. For example, a connector having a conductive member 61 of a diameter of 0.080 inch and oval contacts 27 which compress to a circular configuration of about 0.120 inch, may in turn provide an impedance value of sixty-five ohms. It is thus seen that different impedance values may be provided for the invention through relatively minor dimensional adjustments to the various elements defined herein.

As seen in FIG. 1, each contact is positioned from an adjacent such contact at a distance preferably identical to that of the aforementioned spacings between respective conductors 17. It is preferred that the final spacing (distance "D") between the contact and central conductive rod member 61 be less than that between adjacent such contacts so that the capacitive coupling between contact members 27 and the internally positioned conductive member 61 is substantially greater than the capacitive coupling between adjacent contact members 27. The smaller the distance "D" compared to the minimum distance between adjacent contact members 27, the more the magnetic field generated by signal pulses traveling along said contact members will be drawn toward conductive member 61. This in turn aids in reducing "crosstalk" noise. Should distance "D" be substantially larger than the minimum distance between adjacent contacts 27, the magnetic fields would be drawn more toward adjacent contacts, thereby inducing electrical currents in said adjacent contacts. Such currents, as generated, constitute such "crosstalk" noise, which is understandably most undesirable for effective connector operation.

In a preferred embodiment of the invention, each contact 27 is comprised of beryllium copper material, a known electrical contact material. Another known contact metallic material, phosphor bronze, may also be used. It is also possible to use bimetallic materials (including combinations of the above metals) for the contacts of the invention.

It is thus seen in the embodiment shown in FIGS. 1–3 that contacts 27 are positioned about respective parts 23 of housing 21 in the described engaging manner prior to connector actuation. As also stated, these contacts are prevented from separation from housing 21 by the adjacent projecting ribs and/or upstanding end parts of the housing. Such a capability facilitates both assembly and operation of the invention.

Figure 4:
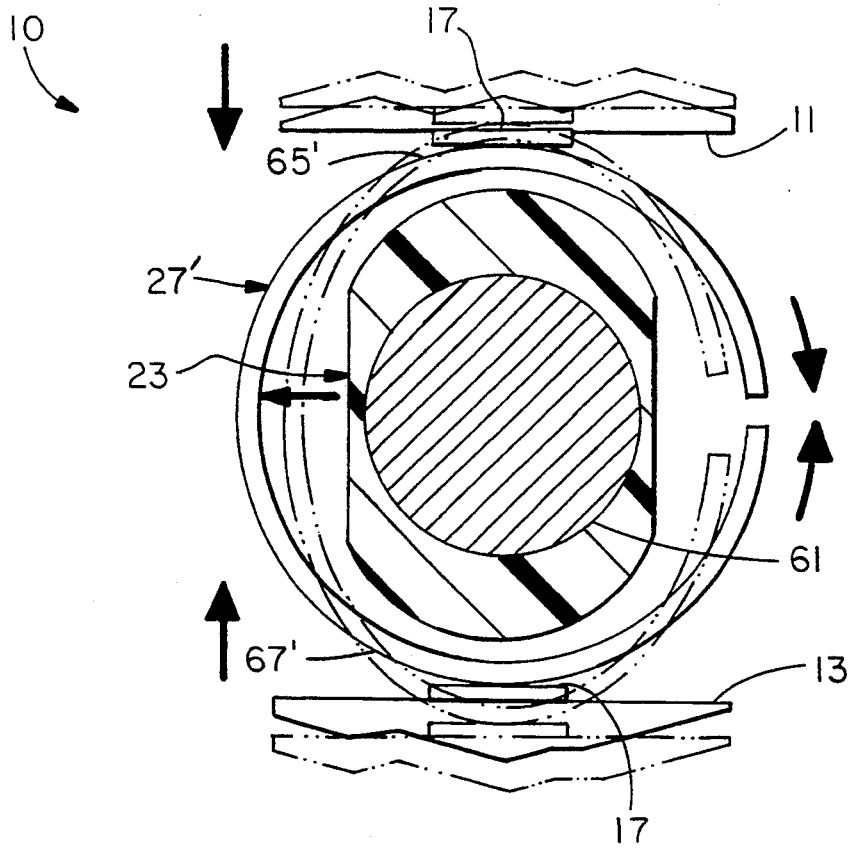
FIG. 4 is a side elevational view of an electrical connector in accordance with another embodiment of the invention, shown in both the open (unactuated, phantom) and actuated positions.

In FIG. 4, there is shown an alternative embodiment of a contact for use with the invention. All other parts of the invention, including particularly housing 21, remain the same. Contact 27' is preferably originally of substantially oval shape (shown in phantom in FIG. 4) and then compressed to the substantially round configuration (shown in solid) depicted. Contact 27' is open-ended; that is, it is of a substantially C-shaped configuration as shown. Effective impedance selection is still attainable using the embodiment of FIG. 4, thus assuring equidistant spacing between the conductive portions 65' and 67' relative to the central conductive member 61 when final compression of contact member 27' occurs. Contact member 27' is preferably of the same material as contact 27 and in turn may possess similar overall original and final external dimensions. The contact in FIG. 4, however, results in a conductive path possessing greater resistance, due to the reduced area.

Figure 5:
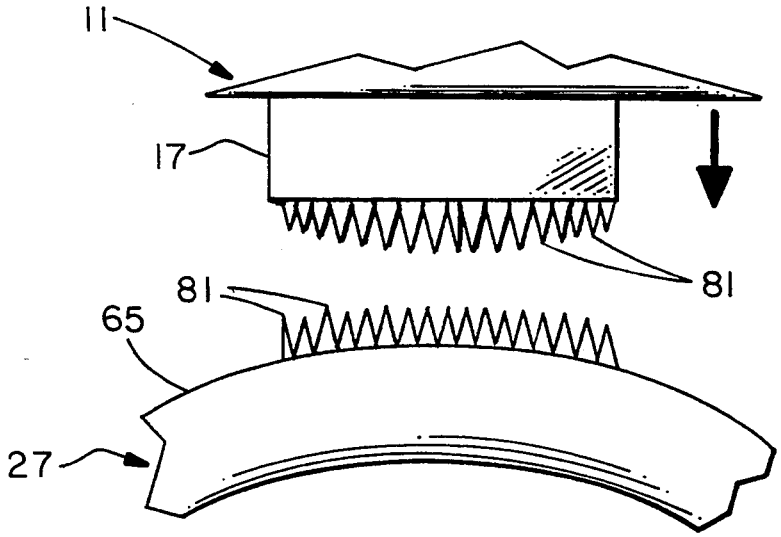
FIG. 5 is a much enlarged partial view of one of the conductive end portions of the contact of the invention, the end portion (and the conductor to which it couples) including thereon a plurality of dendritic conductive projections for enhancing the connection between these two members.

In FIG. 5, there is shown means for enhancing the electrical connection between one or more of the conductive portions (e.g., 65 in FIG. 5) of contact 27 with respect to an adjacent one of the conductors 17. This means preferably comprises a plurality of dendritic protrusions 81 formed on the respective, adjacent external surfaces of portions 65 and conductor 17. It is possible to achieve enhanced connection at this location through the provision of such dendritic protrusions on only the conductive portion 65. Opposed projections are preferred, however. In a preferred embodiment of the invention, these dendritic projections are preferably comprised of palladium or the like conductive material and may be formed on the respective conductive surfaces in accordance with the teachings of U.S. Pat. No. 5,137,461, as well as Canadian Patent 1,121,011. The advantages of such dendritic elements are described in these patents, U.S. Pat. No. 5,137,461 of which is incorporated herein by reference.

In the embodiment depicted in FIG. 1, the conductive rod member 61 further serves as a stiffening member for housing 21 to thus substantially assure rigidity thereof as is considered necessary in such a structure, e.g., to assure planarity thereof when aligned with and connected to substantially planar PCBs or the like. Conductive member 61 thus serves at least two important purposes with regard to the present invention, the stiffening (or reinforcement) purpose being particularly significant when utilizing a multi-part housing of the type described herein.

Figure 6:
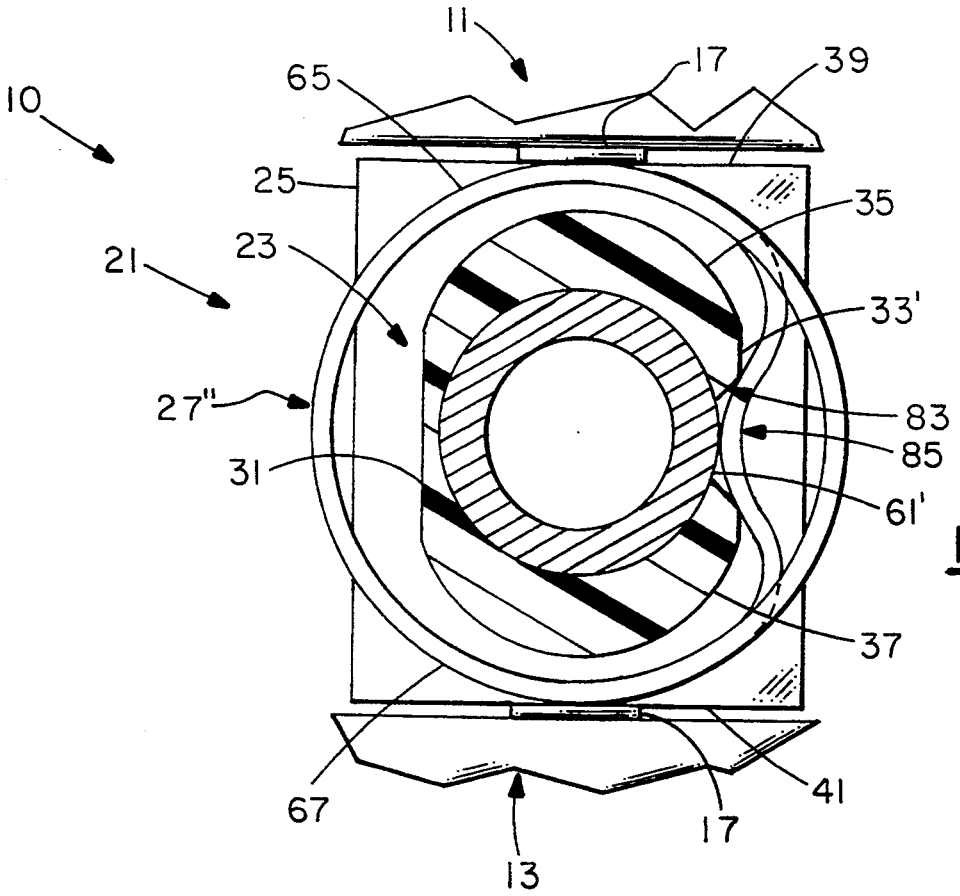
FIG. 6 is a side view similar in scale to FIG. 2, illustrating different embodiments of a contact, housing and conductive member of the invention.
Figure 7:
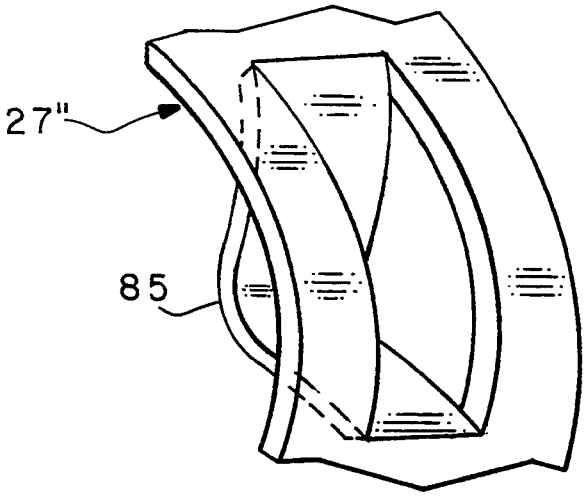
FIG. 7 is a partial, much enlarged view of the contact shown in FIG. 6.

In FIG. 6, connector 10 includes similar elements as in FIG. 3, with modification to the contact (27'') and to the side of part 23 having one of the opposing surfaces (here, 33'). Specifically, this side includes an indentation 83 therein sufficient to expose part of the internally positioned conductive member 61' such that a segment 85 of contact 27'' can make contact with this exposed part. Segment 85 is also shown in FIG. 7 in larger scale. Such engagement serves to enhance positioning of contact 27'' about part 23 by preventing rotational movement (e.g., spin). Such connection may also provide electrical grounding for contact 27'', if desired, assuming of course conductive member 61 is also at ground. Contact 27'' will also initially engage the outer locations on part 23 in a similar manner as shown in FIG. 2. Coupling of selected ones (e.g., alternating) of the invention's contacts may also serve to reduce signal noise during connector operation (in addition to providing selected grounding, as mentioned).

It is also within the scope of the invention to provide cooling for connector 10, when using a hollow conductive member 61' (FIG. 6). An appropriate coupling means could be added (e.g., to one/both ends of member 61) and suitable fluid (e.g., water) passed therethrough.

Centrally positioned conductive member 61' is shown as being hollow, an alternative embodiment discussed earlier herein.

Thus, there has been shown and described an electrical connector which is capable of providing predetermined impedance in order to facilitate design of an overall assembly using such a connector. As stated, such an assembly will include at least two circuit members (e.g., PCBs) as may be utilized in many information handling systems (computers). Typically, such computers include several PCBs and other circuit members as part thereof, all being electrically coupled to respective portions of the overall computer to function in the manner intended. Use of the present invention in such a multi-PCB environment even further enhances the operability of such final assemblies.

While there have been shown and described what are at present considered the preferred embodiments of the invention, it is understood that various modifications and changes may be made thereto without departing from the scope of the invention as defined by the appended claims.

What is claimed is:

1. A connector for electrically interconnecting first and second circuit members, said connector comprising:

an electrically insulative housing adapted for being positioned between said first and second circuit members;

a electrically conductive member positioned within said housing and adapted for conducting electricity during operation of said connector; and at least one electrical contact positioned substantially about said housing and including first and second electrically conductive portions adapted for electrically contacting said first and second circuit members, respectively, said at least one electrical contact adapted for assuming a first configuration substantially about said housing prior to said electrically contacting and thereafter assuming a second, compressed configuration substantially about said housing different than said first configuration during said electrically contacting, said electrically conductive portions of said at least one electrical contact being substantially equidistant from said electrically conductive member when said at least one electrical contact assumes said second, compressed configuration during said electrically contacting with said first and second circuit members to thereby assure a predetermined level of impedance for said connector during operation thereof.

2. The connector according to claim 1 wherein said second, compressed configuration of said at least one electrical contact is substantially round.

3. The connector according to claim 2 wherein said first configuration of said at least one electrical contact is substantially oval.

4. The connector according to claim 1 wherein said at least one electrical contact comprises a closed loop member.

5. The connector according to claim 1 wherein said second configuration of said at least one electrical contact is substantially C-shaped, having an open portion.

6. The connector according to claim 1 including a plurality of said electrical contacts, said housing including a plurality of individual parts, each of said parts of said housing associated with a respective one of said electrical contacts.

7. The connector according to claim 6 wherein each of said electrical contacts is positioned substantially about a respective one of said parts of said housing in a frictionally engaging manner.

8. The connector according to claim 1 wherein said at least one electrical contact is positioned about said housing in a frictionally engaging manner.

9. The connector according to claim 1 wherein said electrically conductive member comprises a substantially cylindrically shaped metallic rod member.

10. The connector according to claim 9 wherein said conductive member is substantially centrally positioned within said housing.

11. The connector according to claim 9 wherein said conductive member is comprised of copper.

12. The connector according to claim 1 wherein at least one of said electrically conductive portions of said at least one electrical contact includes a plurality of dendritic protrusions thereon for electrically contacting a respective one of said circuit members.

13. The connector according to claim 1 wherein said electrically conductive member also provides stiffening for said housing.

14. The connector according to claim 1 wherein said housing is comprised of plastic.

15. The connector according to claim 1 wherein said housing is comprised of ceramic.

16. The connector according to claim 1 wherein said conductive member is adapted for having cooling fluid pass therethrough, to thereby provide cooling for said connector.

17. An information handling system comprising:

a first circuit member;

a second circuit member; and a connector for electrically interconnecting said first and second circuit members, said connector including an electrically insulative housing adapted for being positioned between said first and second circuit members, a electrically conductive member positioned within said housing and adapted for conducting electricity during operation of said connector, and at least one electrical contact positioned substantially about said housing and including first and second electrically conductive portions adapted for electrically contacting said first and second circuit members, respectively, said at least one electrical contact adapted for assuming a first configuration substantially about said housing prior to said electrically contacting and thereafter assuming a second, compressed configuration different than said first configuration during said electrically contacting, said electrically conductive portions of said at least one electrical contact being substantially equidistant from said electrically conductive member when said conductive member conducts said electricity and when said at least one electrical contact assumes said second, compressed configuration during said electrically contacting with said first and second circuit members, to thereby assure a predetermined level of impedance for said connector during operation thereof as part of said information handling system.

* * * * *